US007814771B2

(12) United States Patent
Hirase et al.

(10) Patent No.: US 7,814,771 B2
(45) Date of Patent: Oct. 19, 2010

(54) METHOD FOR CR-PLATING OF MANDREL BARS, THE MANDREL BAR, AND PROCESS FOR PRODUCING SEAMLESS TUBES USING THE METHOD AND THE MANDREL BAR

(75) Inventors: Naoya Hirase, Wakayama (JP); Masaya Kimoto, Amagasaki (JP)

(73) Assignee: Sumitomo Metal Industries, Ltd., Osaka-shi (JP)

( * ) Notice: Subject to any disclaimer, the term of this patent is extended or adjusted under 35 U.S.C. 154(b) by 0 days.

(21) Appl. No.: 12/705,877

(22) Filed: Feb. 15, 2010

(65) Prior Publication Data

US 2010/0139352 A1 Jun. 10, 2010

Related U.S. Application Data

(63) Continuation of application No. PCT/JP2009/055272, filed on Mar. 18, 2009.

(30) Foreign Application Priority Data

Mar. 28, 2008 (JP) ..... 2008-087956

(51) Int. Cl.
*B21B 45/00* (2006.01)

(52) U.S. Cl. ..... 72/47; 72/208

(58) Field of Classification Search ..... 72/46, 72/47, 97, 208, 209, 462, 700; 205/283, 205/287, 290
See application file for complete search history.

(56) References Cited

U.S. PATENT DOCUMENTS 1,581,188 A * 4/1926 Fink ..... 205/283
2,462,615 A * 2/1949 Dubpernell ..... 205/227
3,642,587 A * 2/1972 Allen et al. ..... 205/50
3,922,396 A * 11/1975 Speirs et al. ..... 148/529
4,007,099 A * 2/1977 Wu ..... 205/665
5,176,813 A * 1/1993 Newby ..... 205/284
6,331,241 B1 * 12/2001 Ilgar ..... 205/283
7,165,431 B2 * 1/2007 Iida et al. ..... 72/208
7,179,546 B1 * 2/2007 Chen ..... 428/698

FOREIGN PATENT DOCUMENTS

| | | |
|---|---|---|
| JP | 03-205123 | 9/1991 |
| JP | 08-071618 | 3/1996 |
| JP | 2001-001016 | 1/2001 |
| JP | 2006-188767 | 7/2006 |
| JP | 2006-307322 | 11/2006 |
| WO | WO2004/108311 | 12/2004 |

OTHER PUBLICATIONS

International Search Report in corresponding PCT.JP2009/055272 issued by the Japanese Patent Office Apr. 14, 2009.

* cited by examiner

*Primary Examiner*—Edward Tolan
(74) *Attorney, Agent, or Firm*—Marshall, Gerstein & Borun LLP

(57) ABSTRACT

By using a plating bath containing chromic acid: 100 to 250 g/L, sulfate radical: 3.0 to 5.5 g/L, and a catalyst: 100 to 200% (a weight ratio to the chromic acid content) for conducting electroplating, a Cr-plating film which has an increased film crack density is formed on the surface of a mandrel bar base metal, whereby peeling-off of the Cr-plating film can be suppressed in mandrel mill rolling for extending the service life of the mandrel bar.

3 Claims, 4 Drawing Sheets

METHOD FOR CR-PLATING OF MANDREL BARS, THE MANDREL BAR, AND PROCESS FOR PRODUCING SEAMLESS TUBES USING THE METHOD AND THE MANDREL BAR

TECHNICAL FIELD

The present invention relates to a method for Cr-plating mandrel bars to be used for a mandrel mill rolling in the Mannesmann tube-making process, a mandrel bar, and a process for producing seamless tubes and pipe (hereinafter, simply referred to as "tubes") using the method and the mandrel bar.

BACKGROUND ART

As a production method of seamless tubes by hot working, the Mannesmann-mandrel mill tube-making process is widely adopted. In this tube-making process, a heated round billet is pierced with a piercing machine for producing a thick-wall hollow shell, thereafter with a mandrel bar, which is a rolling tool for constraining the inner surface of the hollow shell, being inserted thereinto, the hollow shell is passed through a mandrel mill including a plurality of stands each comprised of grooved rolls located opposite one another, thus being rolled to a light-wall tube blank. The tube blank obtained by mandrel mill rolling is heated again as required, which is followed by a diameter adjusting rolling with a stretch reducer or sizer for finishing the outside diameter to an end product diameter.

Generally, the mandrel bar for use in mandrel mill rolling is manufactured by using a round bar as a starting material that is a hot working tool steel, such as SKD6 or SKD61 as being defined by the JIS standard, and an appropriate machining, quenching and tempering are applied to the round bar. Normally, on the surface of a mandrel bar, a lubricating film essentially consisting of a solid lubricant is formed in advance in order to reduce the frictional force that is caused by contact with the inner surface of hollow shell during rolling.

However, since the surface of the mandrel bar during rolling is exposed to a tremendously high interfacial pressure and thermal load, it is not easy to ensure a stable lubrication condition, although the lubricating film is formed. Therefore, while the mandrel bar being repeatedly used, the surface and base metal thereof are susceptible to wear, seizure, surface deterioration, and cracks, resulting in the shortening of its service life.

From such circumstances, in a recent mandrel mill rolling, a mandrel bar whose base metal is subjected to Cr-plating to form a hard Cr-plating film on the base metal surface (hereinafter referred to as "Cr-plated mandrel bar") is used. The Cr-plated mandrel bar is protected by a Cr-plating film which is excellent in wear resistance, whereby it provides an excellent durability even in a repetitive use in a mandrel mill rolling, being hardly damaged.

However, the Cr-plating film of the Cr-plated mandrel bar may be peeled off, depending upon use conditions, and once it happens, the base metal comes out in the peeled-off area to thereby get damaged so that it becomes unable to use further the Cr-plated mandrel bar. In order to prevent the mandrel bar from being damaged due to such peeling-off of the Cr-plating film, various proposals for improving service life of mandrel bar have been made.

For example, Japanese Patent Application Publication No. 08-071618 proposes a mandrel bar which has a Cr-plating film with an average thickness of 1 to 100 μm on its base metal surface, and, on the surface of this Cr-plating film, an oxide scale layer essentially consisting of Cr with a thickness of 0.1 to 10 μm. According to the same patent document, by defining the thickness of the Cr-plating film, the peeling-off of the film due to the internal residual stress in the film itself is suppressed, while seizure of the mandrel bar being prevented, and in addition to this, by forming oxide scale on the Cr-plating film and defining the thickness thereof, the lubricity is improved, while allowing the adherence of the Cr-plating film to be improved by action of mutual diffusion of Cr in association with heating at the time of scale formation, whereby the service life of the mandrel bar can be extended.

Japanese Patent Application Publication No. 2001-001016 proposes a mandrel bar which has a Cr-plating film with a thickness of 60 to 200 μm on its base metal surface. According to the same patent document, by defining the thickness of the Cr-plating film, the peeling-off of the film due to the internal residual stress in the film is suppressed, while allowing seizure of mandrel as being caused by the wear of the film to be prevented, whereby the service life of the mandrel bar can be extended.

International Application Publication No. WO2004/108311 proposes a mandrel bar which has a Cr-plating film formed on its base metal surface, wherein its center line average roughness Ra both in an axial direction and a circumferential direction is 1.0 to 5.0 μm, and its maximum depth roughness Rv both in an axial direction and a circumferential direction is 10 μm or over. According to the same patent document, by defining a surface condition of the Cr-plating film both in an axial direction and a circumferential direction, the lubricant can be sufficiently preserved on the film surface during rolling to thereby prevent the seizure of the mandrel bar, and extend the service life of the mandrel bar.

DISCLOSURE OF THE INVENTION

However, in view of costs in producing seamless tubes in the Mannesmann-mandrel mill tube-making process, a tool cost incurred by the mandrel bar has a high proportion thereof, and in the recent years, from the demand for reducing production costs of seamless tubes, the reduction in tool cost for mandrel bar has been strongly urged. Especially, in producing seamless tubes made of high alloy steel (for example, such as 13Cr steel) containing not less than 9% w/w of Cr, which has been increasingly demanded in recent years, a hollow shell made of such high alloy steel having high deformation resistance is to be rolled, and thus the service life of the mandrel bar gets short, whereby a strong demand for its cost reduction is grown. In this regard, while any one of the above-mentioned patent documents is intended for an extended service life of the Cr-plated mandrel bar, however, a further improvement is required.

The present invention has been made in order to meet the above demand for cost reduction, and it is an object thereof to provide a method for Cr-plating mandrel bars which, by optimizing conditions of Cr-plating, allows the peeling-off of the Cr-plating film in the mandrel mill rolling to be suppressed, thereby realizing an extended service life, and to provide the mandrel bar as well as a process for producing seamless tubes.

In order to achieve the above object, the present inventors paid attention to a number of various cracks existing in the Cr-plating film at the stage of the film formation (hereinafter referred to as "film cracks"), with respect to the peeling-off of the Cr-plating film that occurs due to repetitive use of the Cr-plated mandrel bar, causing damage to the base metal. It is presumed that even some shallow film cracks may reach the base metal surface of the mandrel bar due to repetitive use of the mandrel bar. The present inventors presumed that the lubricant or water permeating through cracks of film to reach the mandrel bar base metal at the time of mandrel mill rolling corrodes the base metal, and such corrosion deteriorates the adherence at the boundary between the Cr-plating film and the base metal, leading to the peeling-off of the Cr-plating film. In order to support this presumption, the present inventors conducted a basic test for investigating the implication of the film cracks on the peeling-off of the Cr-plating film.

In this basic test, a plate-like material made of hot working tool steel was used to simulate a mandrel bar base metal, and to this, Cr-plating by electroplating was applied using a plating bath for which the concentrations of chromic acid, sulfate radical ($H_2SO_4$), and a catalyst were varied, thus yielding to test specimens with a Cr-plating film. First, for each test specimen, the surface of the Cr-plating film was microscopically observed for determining the density of film cracks (the number of film cracks/cm).

FIG. 1 is a view showing a frame format for explaining how the film crack density is calculated. As shown in the same figure, a straight line is arbitrarily drawn on the microstructure of the Cr-plating film surface, and within the range of length X of this straight line, the number of points where the straight line intersects with film cracks is counted. The same figure illustrates an example situation in which the straight line intersects with film cracks at seven points as being P1, P2, . . . and P7 within the range of the length X. Then the number of intersections counted is converted into the number of intersections per cm of the straight line, which is defined as the film crack density. In other words, the film crack density represents the number of film cracks per cm of a straight line which is arbitrarily drawn on the microstructure of the Cr-plating film surface.

FIG. 2 is a figure showing one example of the microstructure of the Cr-plating film surface. The Cr-plating film as shown in the same figure has irregular, mesh-like film cracks, the film crack density being 756 (the number of film cracks/cm) or so.

Next, for each test specimen, a salt spray test was conducted to examine the red rust occurrence area ratio (%) which is regarded as an index of the likeliness of peeling-off of the Cr-plating film. The red rust occurrence area ratio represents the ratio of the area covered by red rust to the entire area of the Cr-plating film, and it is understood that the larger the red rust occurrence area ratio, the wider the range of the base metal rusting is.

FIG. 3 is a figure illustrating the correlation between the film crack density and the red rust occurrence area ratio in the salt spray test. As shown in the same figure, it was revealed that, as the film crack density is increased, the red rust occurrence area ratio is decreased. The reason of this is presumably that, as the film crack density is increased, the number of film cracks is increased, but the depth thereof might become shallower, and the number of film cracks which is deep up to the base metal be decreased. In addition, it can be presumed that, when the number of film cracks is increased with the film crack density of the Cr-plating film being increased, the load imposed on the Cr-plating film by repetitive use at the time of mandrel mill rolling is distributed to the increased film cracks to become less affective, which suppresses propagation of the film cracks.

On the other hand, it can be presumed that, when the film crack density is lower, the number of through-film cracks which run through the film up to the mandrel bar base metal is increased with the number of film cracks being reduced, while at the time of mandrel mill rolling, the load is concentrated on fewer shallow film cracks, resulting in propagation of shallow film cracks.

On the basis of these, the present inventors have found that, by increasing the film crack density of the Cr-plating film, shallower film cracks can be formed, and thus propagation of film cracks due to repetitive use of the mandrel bar can be suppressed, resulting in suppressing the corrosion of the mandrel bar base metal by the lubricant or water passed through film cracks. And it has been found that, because the corrosion of the base metal due to repetitive use of the mandrel bar is suppressed, the reduction in adhesion of the Cr-plating film can be prevented, which allows the peeling-off of the Cr-plating film to be suppressed, and thus the service life of the mandrel bar to be extended.

Next, in order to ascertain conditions which allow a Cr-plating film to be sufficiently formed, while also allowing the film crack density of the Cr-plating film to be increased, the film crack density and the electric current efficiency of Cr-plating were evaluated for each of plating baths which were used in making test specimens. Table 1 below gives the results thereof.

TABLE 1

| | Cr-plating bath | | | Evaluation | |
|---|---|---|---|---|---|
| Test No. | Chromic acid concentration (g/L) | Sulfate radical concentration (g/L) | Catalyst concentration (%: weight ratio) | Film crack density | Current efficiency of plating |
| 1 | 100 | 3.0 | 120 | ○ | ○ |
| 2 | 90* | 3.0 | 120 | ○ | X |
| 3 | 100 | 2.5* | 120 | X | ○ |
| 4 | 100 | 3.0 | 100 | Δ | ○ |
| 5 | 90* | 3.0 | 100 | Δ | X |
| 6 | 100 | 2.5* | 100 | X | ○ |
| 7 | 100 | 3.0 | 90* | X | ○ |
| 8 | 250 | 5.5 | 150 | ○ | ○ |
| 9 | 300* | 5.5 | 150 | X | ○ |
| 10 | 250 | 6.0* | 150 | ○ | X |
| 11 | 250 | 5.5 | 200 | ○ | Δ |
| 12 | 300* | 5.5 | 200 | X | Δ |
| 13 | 250 | 6.0* | 200 | ○ | X |
| 14 | 250 | 5.5 | 210* | ○ | X |

Note:
The asterisk (*) indicates that the value asterisked is out of the range defined by the present invention.

Evaluation of the film crack density was carried out to classify into three levels. In the same table, "○" represents an excellent level which is 1.2 or more times higher than the conventional one, "x" represents a inferior level which is equal to or lower than the conventional one, and "Δ" represents a fair level which is between "○" and "x". Evaluation of the current efficiency was carried out to classify into three levels as well. In the same table, "○" represents an excellent level as being equal to or higher than that in ordinary operations, "x" represents a inferior level which ends up in forming an insufficient amount of Cr-plating film (actual amount of precipitation), and "Δ" represents a fair level between "○" and "x".

As can be seen from Table 1, when a plating bath which has a concentration of chromic acid in the range of 100 to 250 g/L, a concentration of sulfate radical in the range of 3.0 to 5.5 g/L, and a concentration of the catalyst in the range of 100 to 200% (a weight ratio to the chromic acid content) is used, the film crack density and the current efficiency both reach an excellent level, and further if the catalyst concentration is in the range of 120 to 150%, the film crack density and the current efficiency both become much more excellent. Thereby, the present inventors has had a finding that, in order to increase the film crack density of the Cr-plating film which has been sufficiently formed, it is effective to properly adjust the composition of the plating bath to be used at the time of Cr-plating.

The present invention has been completed on the basis of such a finding, and the gist thereof is a method for Cr-plating mandrel bars as stated in the following item (1), a mandrel bar as stated in the following item (2), and a process for producing seamless tubes as stated in the following item (3).

(1) A method for Cr-plating mandrel bars to be used for a mandrel mill rolling in the Mannesmann tube-making process, the method using a plating bath containing chromic acid: 100 to 250 g/L, sulfate radical: 3.0 to 5.5 g/L, and a catalyst: 100 to 200% (a weight ratio to the chromic acid content) for conducting electroplating to form a Cr-plating film on the surface of a mandrel bar base metal.

(2) A mandrel bar to be used for a mandrel mill rolling in the Mannesmann tube-making process, the mandrel bar having a Cr-plating film which is formed on the surface of a base metal, using a plating bath containing chromic acid: 100 to 250 g/L, sulfate radical: 3.0 to 5.5 g/L, and a catalyst: 100 to 200% (a weight ratio to the chromic acid content) for conducting electroplating.

(3) A process for producing seamless tubes that, in producing seamless tube, uses the mandrel bar as stated in the above item (2) for mandrel mill rolling of a hollow shell which has been piercing-rolled. This process is effective especially for producing seamless tubes made of high alloy steel containing not less than 9% w/w of Cr.

The chromic acid mentioned here means anhydrous chromium oxide ($CrO_3$), and the sulfate radical means sulfuric acid ion ($SO_4^{2-}$). The catalyst means an adjuvant additive different from the catalytic sulfate radical, and this catalyst may be that as being conventionally used for Cr-plating; for example, an organic acid, such as acetic acid, formic acid or sulfonic acid may be adopted.

According to the present invention, by applying Cr-plating to a mandrel bar base metal, using a plating bath in which the concentrations of chromic acid, sulfate radical, and a catalyst are defined, a Cr-plating film with an increased film crack density can be formed. Because the Cr-plating film of this Cr-plated mandrel bar has an increased film crack density, shallower film cracks can be formed, propagation of the film cracks due to repetitive use in the mandrel mill rolling can be suppressed, and corrosion of the base metal by the lubricant or water passed through the film cracks and peeling-off of the Cr-plating film can be suppressed, whereby the service life of the mandrel bar can be extended.

BEST MODE FOR CARRYING OUT THE INVENTION

Figure 1:
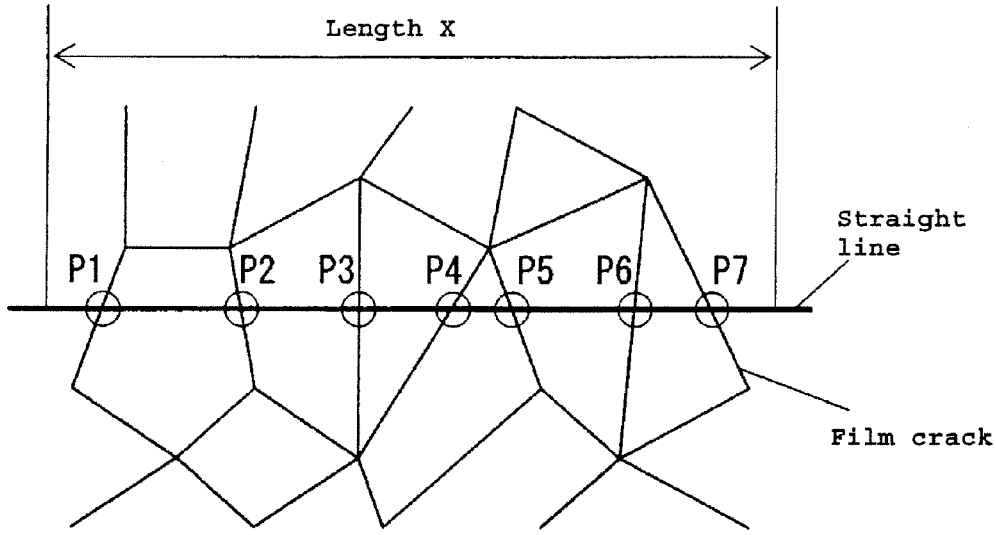
FIG. 1 is a view showing a frame format for explaining how the film crack density is calculated.
Figure 2:
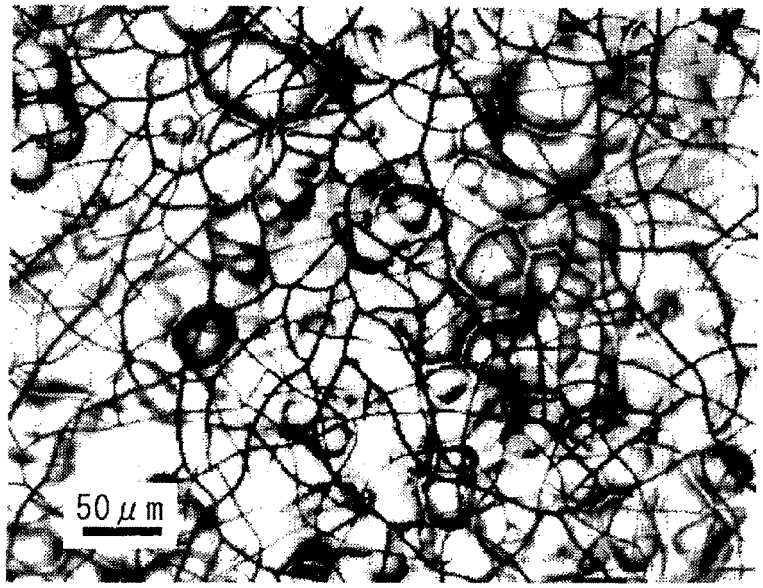
FIG. 2 is a figure showing one example of the microstructure of the Cr-plating film surface.
Figure 3:
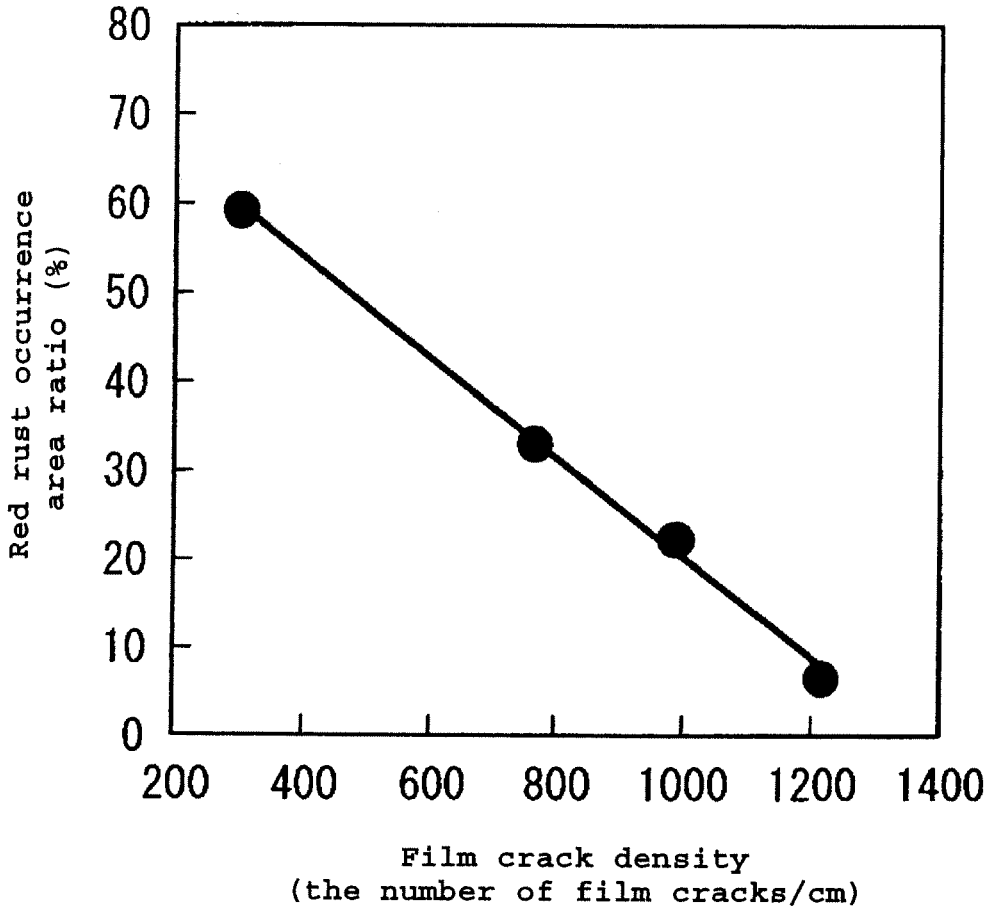
FIG. 3 is a figure illustrating the correlation between the film crack density and the red rust occurrence area ratio in the salt spray test.

As described above, in the present invention, in Cr-plating a mandrel bar, a plating bath containing chromic acid: 100 to 250 g/L, sulfate radical: 3.0 to 5.5 g/L, and a catalyst: 100 to 200% (a weight ratio to the chromic acid content) is used for conducting electroplating.

Here is a description of the reason why the concentrations of chromic acid, sulfate radical, and a catalyst are defined for a plating bath to be used for formation of a Cr-plating film on the surface of the mandrel bar base metal.

As can be seen from Table 1 above, when the chromic acid concentration exceeds 250 g/L, when the sulfate radical concentration is under 3.0 g/L, or when the catalyst concentration is under 100%, the film crack density is lowered to a level equal to or lower than the conventional one. In this case, with the film crack density being lowered, the number of film cracks which reach the mandrel bar base metal is increased, the number of film cracks being decreased, thus at the time of mandrel mill rolling, the load is concentrated on fewer film cracks, resulting in propagation of shallow film cracks. Therefore, corrosion of the base metal by the lubricant or water cannot be suppressed, resulting in occurrence of peeling-off of the Cr-plating film, which makes it impossible to extend the service life of the mandrel bar.

On the other hand, when the chromic acid concentration is under 100 g/L, when the sulfate radical concentration exceeds 5.5 g/L, or when the catalyst concentration exceeds 200%, the current efficiency of Cr-plating is lowered, resulting in forming the Cr-plating film insufficiently.

Therefore, in the present invention, the chromic acid concentration in the plating bath is defined as being in the range of 100 to 250 g/L, the sulfate radical concentration is also defined as being in the range of 3.0 to 5.5 g/L, and further the catalyst concentration is defined as being in the range of 100 to 200%. More preferably, the catalyst concentration in the plating bath is defined as being in the range of 120 to 150%.

In the present invention, by applying Cr-plating to the mandrel bar base metal by means of electroplating using a plating bath in which the concentrations of chromic acid, sulfate radical, and a catalyst are specifically defined, a Cr-plating film can be sufficiently formed on the base metal surface to provide a mandrel bar having a Cr-plating film with an increased film crack density. With this Cr-plated mandrel bar, the film crack density of the Cr-plating film is increased, thus, shallower film cracks can be formed, propagation of the film cracks due to repetitive use in the mandrel mill rolling can be suppressed, and the corrosion of the base metal by the lubricant or water passed through the film cracks can be suppressed. As a result of this, the peeling-off of the Cr-plating film can be suppressed, which allows the service life of the mandrel bar to be extended.

At this time, although the film crack density of the Cr-plating film varies according to the size of the mandrel bar diameter, even when Cr-plating is carried out using a plating bath having the same composition, it can be increased by using a plating bath in which the concentrations of chromic acid, sulfate radical, and a catalyst are defined as described above. Therefore, the present invention is applicable to any size of mandrel bar diameter.

In addition, even when the above-described mandrel bar of the present invention is used in a mandrel mill rolling for producing seamless tubes made of high alloy steel containing not less than 9% w/w of Cr, such as 13Cr steel, the service life thereof can be extended with an internal surface quality of the product tube being improved, and its production cost can be reduced. Needless to say, such advantages of the mandrel bar of the present invention can also be exhibited in producing seamless tubes made of plain steel.

EXAMPLES

In order to verify the advantages of the present invention, the following tests were conducted using a commercial equipment.

Example 1

A mandrel bar base metal made of SKD61 as defined by JIS was prepared, and an electroplating equipment was used to apply Cr-plating to the base metal for formation of a Cr-plating film on the base metal surface. At that time, as an example embodiment of the present invention, five mandrel bars were subjected to Cr-plating using a plating bath which had the concentration ranges defined by the present invention, and as a comparative example, five mandrel bars were subjected to Cr-plating using a plating bath which was out of the concentration ranges defined by the present invention. At that time, the current density was set to 40 $A/dm^2$.

Using these Cr-plated mandrel bars for the example embodiment of the present invention and the comparative example, hollow shells made of 13Cr steel as workpieces were subjected to mandrel mill rolling in Example 1. Then, for each mandrel bar, the number of passes (the number of workpieces rolled) until the service life was reached was investigated. Determination of whether the service life was reached was performed on the basis of whether there occurred the seizure due to peeling-off of the Cr-plating film. In addition, prior to the mandrel mill rolling, the film crack density of the Cr-plating film was investigated for each mandrel bar.

Figure 4:
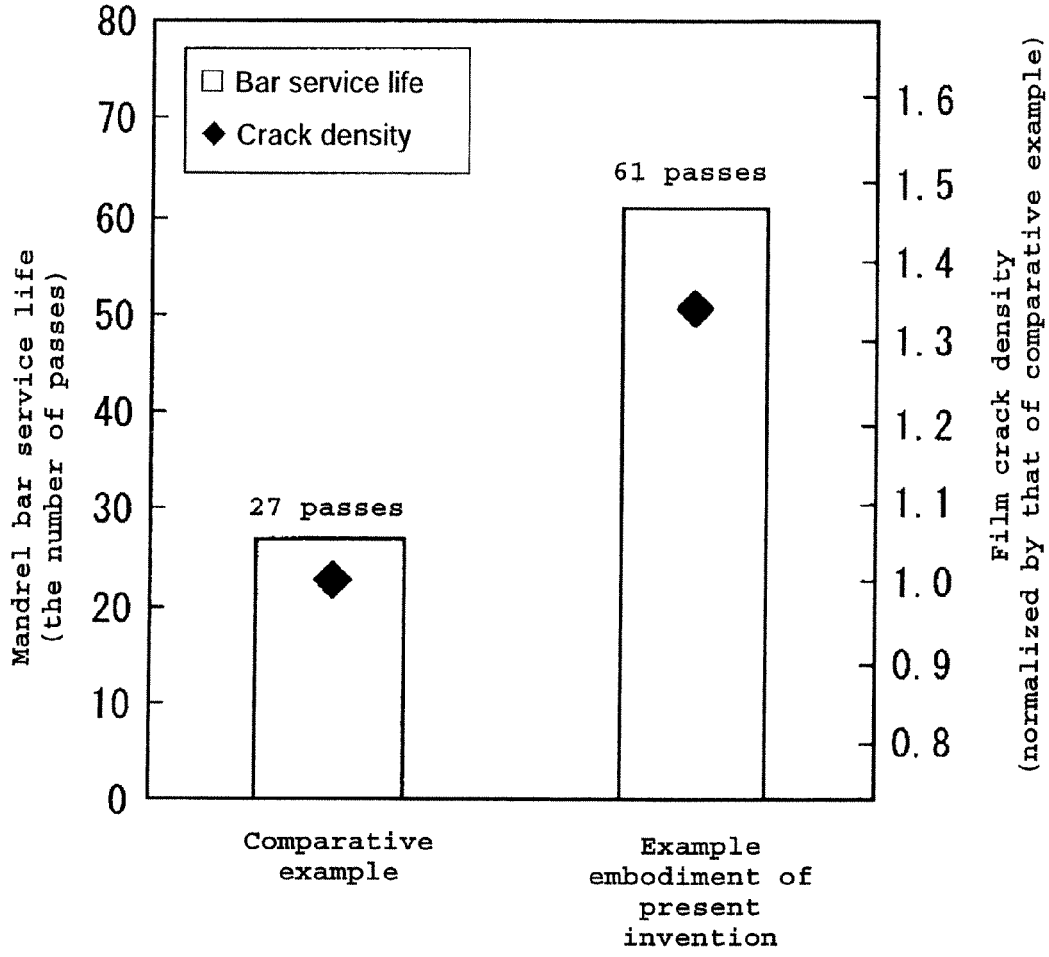
FIG. 4 is a figure illustrating the relation between the service life in mandrel mill rolling and the film crack density of the mandrel bar for an example embodiment of the present invention and a comparative example in Example 1.

FIG. 4 is a figure illustrating the relation between the service life in mandrel mill rolling and the film crack density of the mandrel bar for the example embodiment of the present invention and the comparative example in Example 1. In the same figure, the service life (the number of passes) of the mandrel bar is represented by averaging obtained results for both of the example embodiment of the present invention and the comparative example. In addition, the film crack density is represented by averaging obtained results for both of the example embodiment of the present invention and the comparative example, and is normalized by setting the average value for comparative examples to the norm (1.0).

As shown in the same figure, in the test in Example 1, the mandrel bar for the example embodiment of the present invention had a film crack density 1.3 times or more as high as for the comparative example, while the service life being doubled or more.

Example 2

Under the same conditions as those in Example 1, five Cr-plated mandrel bars for the example embodiment of the present invention and those of the same number for the comparative example were manufactured, and using these Cr-plated mandrel bars, hollow shells made of carbon steel (0.18% C) as workpieces were subjected to mandrel mill rolling in Example 2. And in the same manner as in Example 1, the service life and the film crack density were investigated for each mandrel bar.

Figure 5:
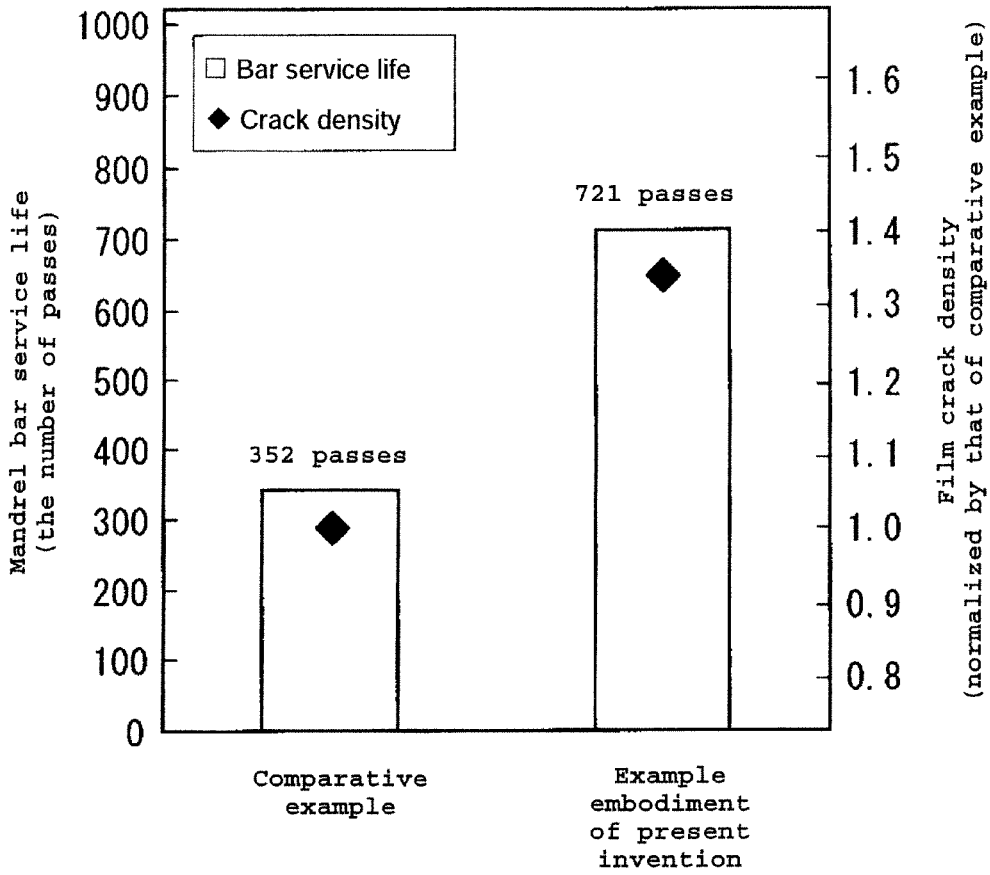
FIG. 5 is a figure illustrating the relation between the service life in mandrel mill rolling and the film crack density of the mandrel bar for an example embodiment of the present invention and a comparative example in Example 2.

FIG. 5 is a figure illustrating the relation between the service life in mandrel mill rolling and the film crack density of the mandrel bar for the example embodiment of the present invention and the comparative example in Example 2. As shown in the same figure, in the test in Example 2, the mandrel bar for the example embodiment of the present invention had a film crack density 1.3 times or more as high as for the comparative example, while the service life being doubled or more.

INDUSTRIAL APPLICABILITY

According to the present invention, by applying Cr-plating by electroplating to a mandrel bar base metal, using a plating bath in which the concentrations of chromic acid, sulfate radical, and a catalyst are specifically defined, a Cr-plating film which has an increased film crack density can be formed. Because the Cr-plating film of this Cr-plated mandrel bar has an increased film crack density, even if the Cr-plated mandrel bar is repetitively used in mandrel mill rolling, corrosion of the base metal by the lubricant or water can be suppressed, and thus peeling-off of the Cr-plating film can be suppressed, whereby the service life of the mandrel bar can be extended.

What is claimed is:

1. A method for Cr-plating of mandrel bars to be used for a mandrel mill rolling in the Mannesmann tube-making process, the method using a plating bath containing chromic acid: 100 to 250 g/L, sulfate radical: 3.0 to 5.5 g/L, and a catalyst: 100 to 200% (a weight ratio to the chromic acid content; g sulfonic acid×100/g chromic acid) for conducting electroplating to form a Cr-plating film on the surface of a mandrel bar base metal.

2. A mandrel bar to be used for a mandrel mill rolling in the Mannesmann tube-making process, the mandrel bar having a Cr-plating film which is formed on the surface of a base metal, using a plating bath containing chromic acid: 100 to 250 g/L, sulfate radical: 3.0 to 5.5 g/L, and a catalyst: 100 to 200% (a weight ratio to the chromic acid content; g sulfonic acid×100/g chromic acid) for conducting electroplating.

3. A process for producing seamless tubes, using the mandrel bar according to claim 2 for mandrel mill rolling of hollow shells which have been piercing-rolled.

* * * * *